US009151301B2

(12) United States Patent
Combley et al.

(10) Patent No.: US 9,151,301 B2
(45) Date of Patent: Oct. 6, 2015

(54) HYDRAULIC SYSTEM AND ARRANGEMENT FOR AN ACCESS ARRANGEMENT

(75) Inventors: Michael I. Combley, Ripon, CA (US); Dante V. DeLeo, Santa Clarita, CA (US)

(73) Assignee: Ricon Corp., Panorama City, CA (US)

( * ) Notice: Subject to any disclaimer, the term of this patent is extended or adjusted under 35 U.S.C. 154(b) by 476 days.

(21) Appl. No.: 13/493,184

(22) Filed: Jun. 11, 2012

(65) Prior Publication Data

US 2013/0327032 A1 Dec. 12, 2013

(51) Int. Cl.

| | |
|---|---|
| ***A61G 3/06*** | (2006.01) |
| ***F15B 13/02*** | (2006.01) |
| ***F15B 20/00*** | (2006.01) |

(52) U.S. Cl.

CPC ..... *F15B 13/025* (2013.01); *F15B 20/00* (2013.01); *A61G 3/061* (2013.01); *A61G 3/062* (2013.01); *F15B 2211/3056* (2013.01); *F15B 2211/30505* (2013.01); *F15B 2211/3138* (2013.01); *F15B 2211/40507* (2013.01); *F15B 2211/40584* (2013.01); *F15B 2211/411* (2013.01); *F15B 2211/41581* (2013.01); *F15B 2211/50554* (2013.01); *F15B 2211/5158* (2013.01); *F15B 2211/761* (2013.01); *F15B 2211/8603* (2013.01); *F15B 2211/8643* (2013.01)

(58) Field of Classification Search

CPC ..... B66F 9/22; F15B 20/00; F15B 13/025; F15B 2211/5158; A61G 3/062

USPC ..... 91/454, 403; 60/468

See application file for complete search history.

(56) References Cited

U.S. PATENT DOCUMENTS

| | | | | |
|---|---|---|---|---|
| 4,739,617 | A * | 4/1988 | Kreth et al. | 60/426 |
| 5,546,980 | A * | 8/1996 | Kosarzecki | 137/454.5 |
| 5,674,043 | A | 10/1997 | Dorn | |
| 6,379,102 | B1 | 4/2002 | Kameda | |
| 7,530,226 | B2 * | 5/2009 | Goodrich | 60/468 |
| 2002/0076313 | A1 | 6/2002 | Vartanian, Sr. | |
| 2004/0146386 | A1 | 7/2004 | Goodrich | |
| 2005/0238471 | A1 | 10/2005 | Ablabutyan et al. | |

* cited by examiner

*Primary Examiner* — Nathaniel Wiehe
*Assistant Examiner* — Abiy Teka
(74) *Attorney, Agent, or Firm* — The Webb Law Firm

(57) ABSTRACT

A hydraulic system for an access arrangement having a platform configured for movement between a deployed position and a stowed position, the hydraulic system including: at least one hydraulic power unit configured to urge hydraulic fluid through a hydraulic circuit; at least one hydraulic cylinder directly or indirectly connected to a portion of the platform and configured to urge the platform towards at least one of the stowed position and the deployed position, wherein the at least one hydraulic cylinder is in fluid communication with the hydraulic power unit; and a pressure regulating valve in a path between the at least one hydraulic power unit and the at least one hydraulic cylinder, wherein the pressure regulating valve is operable to prevent the at least one hydraulic cylinder from urging the platform to the stowed position if a load on the platform exceeds a specified threshold.

20 Claims, 6 Drawing Sheets

HYDRAULIC SYSTEM AND ARRANGEMENT FOR AN ACCESS ARRANGEMENT

BACKGROUND OF THE INVENTION

1. Field of the Invention

The present invention relates generally to the operation of an access arrangement, such as a wheelchair lift, an access ramp, a moveable access arrangement, or the like, and in particular to a hydraulic system for causing the access arrangement to move between various predefined positions, such as the ground position, the deployed position, and the stowed position.

2. Description of the Related Art

In order to provide access by individuals having restricted mobility to various areas and in specific environments, an access arrangement must be used. For example, a person utilizing a wheelchair or that has diminished physical capacity may use a ramp, an elevator, an escalator, or the like. Similarly, in order to provide such a person with full access between remote locations, the mode of transportation must also be equipped with an access arrangement, such as a lift apparatus that includes a platform. This lift arrangement can be equipped on a van or similar vehicle, and is operable between a stowed position (where the platform is positioned in the vehicle), a deployed position (where the platform is extending from the vehicle at the vehicle floor level), and a ground position (where the platform is resting or adjacent the outside ground surface).

Known lift and access arrangements are available and either manufactured integrally with the vehicle, or retrofitted to an appropriate access vehicle. Depending upon the size and configuration of the access arrangement, various driving forces and lifting systems can be used, such as mechanical systems, electrical systems, hydraulic systems, electro-pneumatic systems, or combinations thereof. One of the most common lifting systems used includes hydraulic cylinders to move the platform between the stowed, deployed, and ground positions. For example, a left hydraulic cylinder and a right hydraulic cylinder may work in unison to move the platform between positions, and these hydraulic cylinders are operable through the regulated flow of hydraulic fluid thereto.

In order to provide such regulated flow of hydraulic fluid and control the operation of the hydraulic cylinders, a hydraulic circuit is provided that includes the necessary pumps and valves to control the flow of the fluid throughout the circuit. In particular, by controlling and appropriately routing the flow of hydraulic fluid throughout the circuit, and thus, controlling the flow of hydraulic fluid to and from the hydraulic cylinders, an operator is provided with the ability to cause the platform to move between appropriate positions.

For access from the vehicle to the outside environment, and in operation, the platform is urged to the deployed position, and the user moves onto the platform, whereupon the operator causes the platform to move to the ground level, such that the user can move off the platform. For reentry to the vehicle, the platform starts at the ground position, and once the user moves onto the platform, the operator causes the platform to move to the deployed position, whereupon the user moves in to the inner area of the vehicle. Once the user enters the vehicle, the operator causes the platform to be stowed, i.e., moved between the deployed position and the stowed position.

In certain circumstances, potentially unsafe situations can arise. For example, if the user is wholly on the platform, or still in the process of moving from the platform (in the deployed position) to the inner area of the vehicle, the operator may request that the platform be stowed, e.g., through the actuation of a button, switch, or the like. Obviously, if the platform begins to stow with a user wholly or partially thereon, an unsafe and dangerous situation occurs.

Therefore, there is a need to ensure that the motive or driving system, such as a hydraulic system, cannot effectively urge the platform from the deployed position to the stowed position if a person is present thereon. Certain multi-valve arrangements have been introduced that require positive activation and introduce a bypass circuit within the overall hydraulic circuit, such as the circuit shown and described in U.S. Pat. No. 7,530,226. However, such known arrangements have particular, potential failure points and inefficiencies that leave room for improvement in this area. Ensuring the safety of the users of such access arrangements is paramount, and improvements that lead to additional safety features are beneficial.

SUMMARY OF THE INVENTION

Generally, the present invention provides a hydraulic system and arrangement for an access arrangement that addresses or overcomes certain drawbacks and deficiencies present in existing hydraulic systems in the area of access systems, such as vehicle access systems and arrangements. Preferably, the present invention provides a hydraulic system and arrangement for an access arrangement that prevents movement of a platform of the access arrangement between specific positions and in certain situations. Preferably, the present invention provides a hydraulic system and arrangement for an access arrangement that prevents the platform of the access arrangement from stowing if a user is wholly or partially thereon. Preferably, the present invention provides a hydraulic system and arrangement for an access arrangement that leads to enhanced safety and other benefits to both the user and operator of the access arrangement.

Accordingly, and in one preferred and non-limiting embodiment, provided is a hydraulic system for an access arrangement having a platform configured for movement between a deployed position and a stowed position. The hydraulic system includes at least one hydraulic power unit to urge hydraulic fluid through a hydraulic circuit, and at least one hydraulic cylinder directly or indirectly connected to a portion of the platform and configured to urge the platform towards at least one of the stowed position and the deployed position. The at least one hydraulic cylinder is in fluid communication with the hydraulic power unit. Further, a pressure regulating valve is positioned in a path between the at least one hydraulic power unit and the at least one hydraulic cylinder, wherein the pressure regulating valve is operable to prevent the at least one hydraulic cylinder from urging the platform to the stowed position if a load on the platform exceeds a specified threshold.

In another preferred and non-limiting embodiment, and in a hydraulic system for an access arrangement having a platform connected to at least one hydraulic cylinder to urge the platform between a deployed position and a stowed position, provided is a pressure regulating valve in a path between at least one hydraulic power unit and the at least one hydraulic cylinder and configured to urge hydraulic fluid through a hydraulic circuit and to the at least one hydraulic cylinder. The at least one hydraulic cylinder is in fluid communication with the hydraulic power unit, and the pressure regulating valve is operable to prevent the at least one hydraulic cylinder from urging the platform to the stowed position if a load on the platform exceeds a specified threshold.

In a still further preferred and non-limiting embodiment, provided is a hydraulic arrangement for an access arrangement having a platform configured for movement between a deployed position and a stowed position. This hydraulic arrangement includes: fluid urging means for urging hydraulic fluid through a hydraulic circuit; platform urging means for urging a platform towards at least one of the stowed position and the deployed position, wherein the platform urging means is in fluid communication with the fluid urging means; and pressure regulating means in a continual path between the fluid urging means and the platform urging means, wherein the pressure regulating means prevents the platform urging means from urging the platform to the stowed position if a load on the platform exceeds a specified threshold by limiting the pressure of the hydraulic fluid conveyed through the pressure regulating means.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE PREFERRED EMBODIMENT(S)

Figure 1:
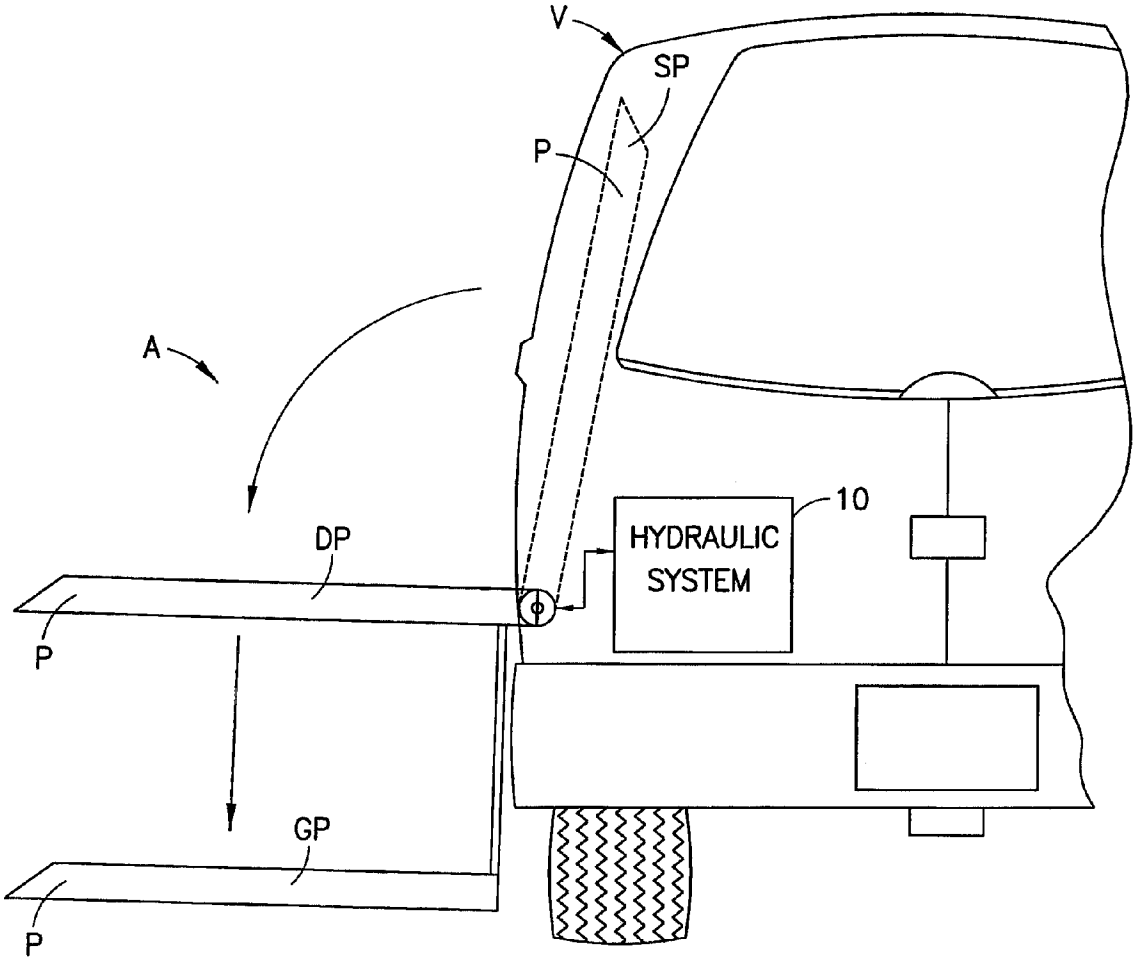
FIG. 1 is a schematic view of one embodiment of a hydraulic system and arrangement for an access arrangement according to the principles of the present invention, where the access arrangement is interconnected with a vehicle.

For purposes of the description hereinafter, the terms "end", "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

The present invention provides a hydraulic system and arrangement that can be used in connection with a variety of access arrangements. For example, and as discussed above, the presently-invented hydraulic system 10 can be used in connection with a vehicle V, as illustrated in FIG. 1. However, it is also envisioned that the hydraulic system 10 can be used in connection with any known access arrangement, including a wheelchair lift, an access ramp, a movable access arrangement, and the like. Specifically, the present invention can be integrated with and/or retrofitted to a new or existing access arrangement that provides a movable platform P that can be moved or actuated between specified positions. As seen in FIG. 1, and when used in connection with the vehicle V, the platform P can be moved between a stowed position SP, where the platform is positioned partially or wholly within the vehicle V, a deployed position DP, where the platform P is extending from the vehicle V at a vehicle floor level, and a ground position GP, where the platform P is resting or adjacent the outside ground surface to which the user wishes to gain access.

In addition, while the presently-invented hydraulic system 10 is primarily discussed in terms of a system and arrangement based upon the delivery and usage of hydraulic fluid, it is also envisioned that other similar motive forces and arrangements can be utilized. For example, the hydraulic system 10 can also be implemented in a pneumatic or pneumatic-electric environment.

Figure 2:
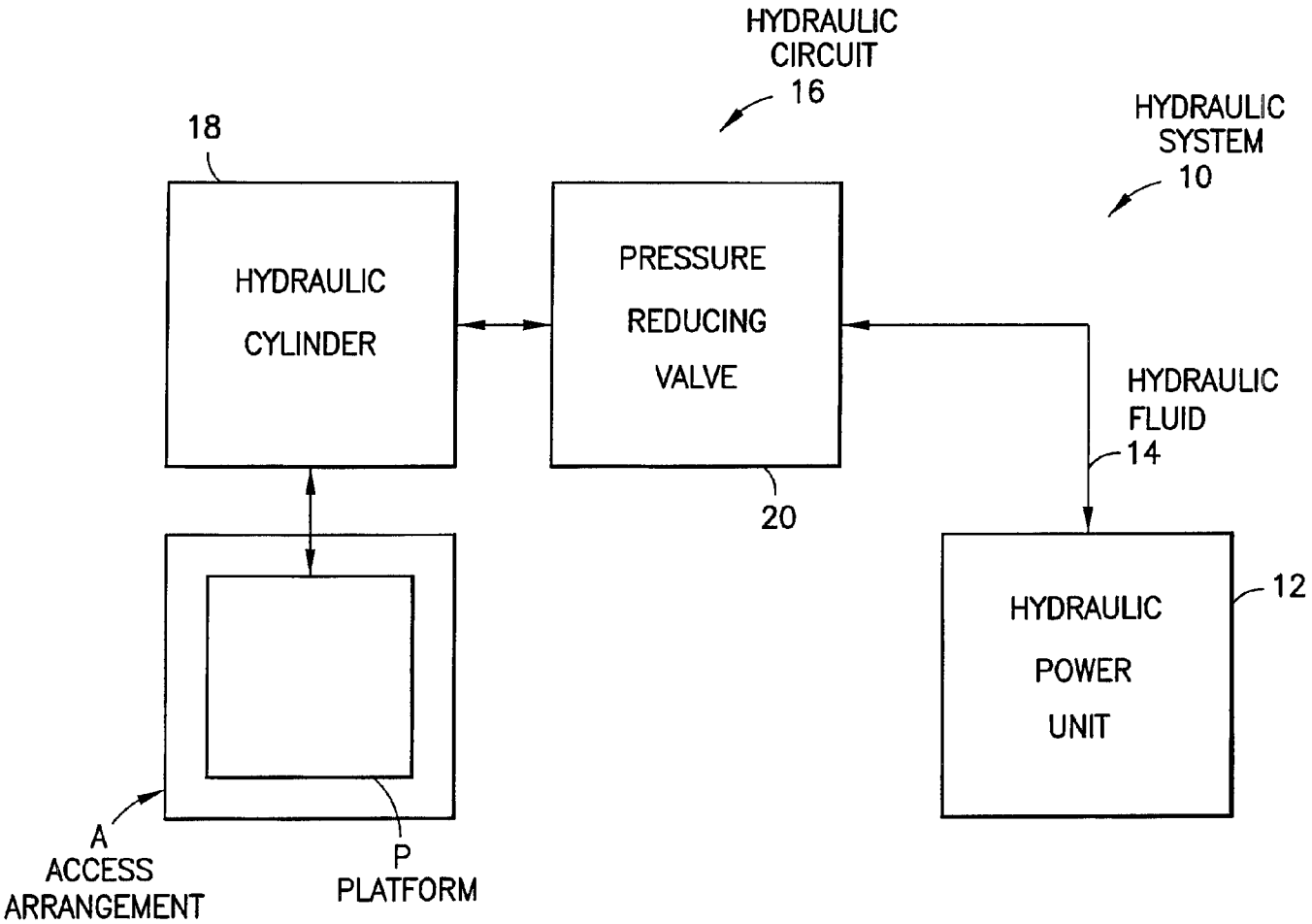
FIG. 2 is a schematic view of another embodiment of a hydraulic system and arrangement for an access arrangement according to the principles of the present invention.

One preferred and non-limiting embodiment of a hydraulic system 10 according to the present invention is illustrated in FIG. 2. In this embodiment, the hydraulic system 10 includes at least one hydraulic power unit 12 that is operative or adapted to urge hydraulic fluid 14 through a hydraulic circuit 16. As discussed in detail hereinafter, this hydraulic circuit 16 includes numerous components and valves in order to deliver and/or regulate the flow of hydraulic fluid 14 through the hydraulic system 10.

The hydraulic system 10 also includes at least one hydraulic cylinder 18 that is directly or indirectly connected to a portion of the platform P. This hydraulic cylinder 18 is used to urge the platform between the various positions, such as the deployed position DP and the stowed position SP. In addition, the hydraulic cylinder 18 is in fluid communication with the hydraulic power unit 12, such that the hydraulic cylinder 18 is operable. In addition, it is noted that the hydraulic cylinder 18 acts in the conventional manner known in the art, e.g., an arrangement utilizing a compressible piston/piston rod operating within a cylinder barrel.

The hydraulic system 10 of the present invention further includes a pressure regulating valve 20 that is positioned in a path in the hydraulic circuit 16 between the hydraulic power unit 12 and the hydraulic cylinder 18. This pressure regulating valve 20 is configured and operable to prevent the hydraulic cylinder 18 from urging the platform P to the stowed position SP if a load on the platform P exceeds a specified threshold. In one preferred and non-limiting embodiment, the pressure regulating valve is continually present and operable in the hydraulic circuit 16.

In this manner, and by using a pressure regulating valve 20 that is continually present in the hydraulic circuit 16, if a specified weight or load is present on the platform P when an operator attempts to stow the platform P, i.e., move the platform P from the deployed position DP to the stowed position, SP, the hydraulic cylinder 18 cannot build up enough pressure to actuate. Therefore, if a person, such as a wheelchair user, is wholly or partially on the platform P, and the operator presses the button or otherwise attempts to stow the platform P, the platform P will not move, which would cause potential injury to the user.

Another advantage of the present invention is that by having the pressure regulating valve 20 continually in a path in the hydraulic circuit 16, a fail-safe arrangement is provided. Specifically, the pressure regulating valve 20 represents a mechanically-operable arrangement that does not rely upon some positive act of actuation or electrical activation in order to place a safeguard in the hydraulic circuit. Instead, due to the unique positioning and operation of the pressure regulating valve 20, the safeguard, i.e., the platform P will not stow with a user positioned thereon, will be continually provided in the hydraulic circuit 16 of the present invention.

Yet another advantage of the unique positioning and usage of the pressure regulating valve 20, as discussed in more detail hereinafter, is the prevention of the platform P from lowering from the deployed position DP to the ground position GP, which may occur if a bypass circuit was utilized. Instead, by maintaining the appropriate pressure through the pressure regulating valve 20 to the hydraulic cylinder 18, attempted stowing by the operator (or the user) while the user is on the platform P will simply result in the platform P staying at the deployed position DP. Accordingly, the platform P will neither stow nor begin to lower towards the ground position GP.

Figure 3:
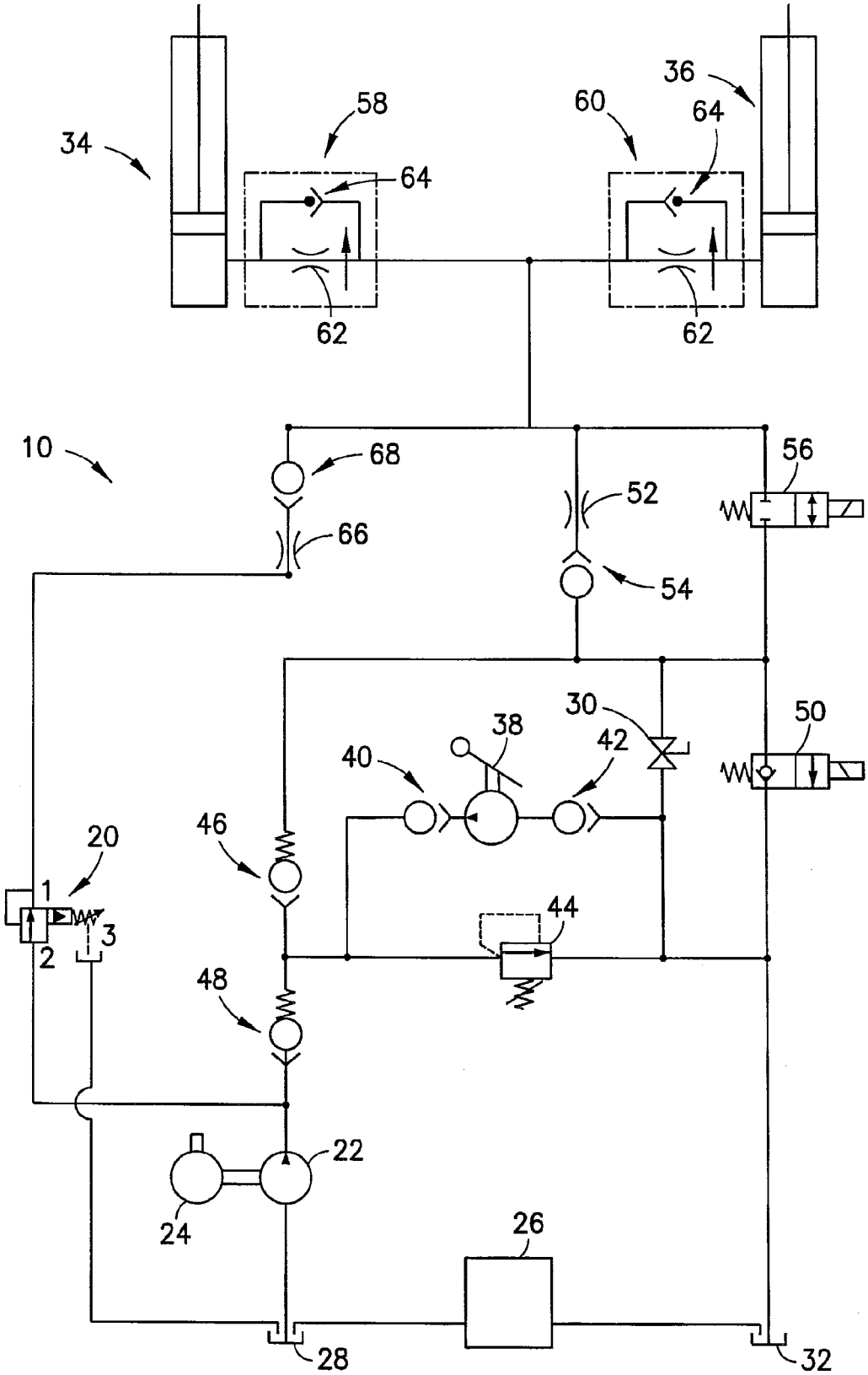
FIG. 3 is a flow diagram of one embodiment of a hydraulic system and arrangement for an access arrangement according to the principles of the present invention.

As discussed above, and as illustrated in schematic form in FIG. 3, another preferred and non-limiting embodiment of the hydraulic system 10 includes the additional functioning components and equipment in order to move the platform P between the various positions (i.e., the ground position GP, the deployed position DP, and the stowed position SP). In particular, this embodiment of the hydraulic system 10 provides a hydraulic power unit 12 in the form of a pump 22 that is driven by a motor 24. Accordingly, the pump 22 is in direct or indirect fluid communication with a hydraulic storage unit 26. Specifically, the pump 22 may receive hydraulic fluid 14 directly from the fluid storage unit 26, or from a separate fluid reservoir 28, which may be in the form of a pan or open storage unit. Further, the pump 22 is operable to urge hydraulic fluid 14 from the fluid storage unit 26 or fluid reservoir 28 to and throughout the hydraulic circuit 16. This hydraulic fluid 14 may be provided at a constant or variable flow rate and pressure.

As discussed hereinafter, multiple check valves and other components are provided to control the flow of hydraulic fluid 14 through the hydraulic circuit 16. For example, the hydraulic system 10 is provided with specific components and equipment that allow for the movement of the platform P between positions when the pump 22 is inoperative or malfunctioning. Specifically, a manual release valve 30 is provided to allow for the drainage of hydraulic fluid 14 to the fluid storage unit 26 and/or another fluid reservoir 32. In this manner, the platform P can be moved from the stowed position SP to the deployed position DP and/or between the deployed position DP and the ground position GP. This is accomplished through the release of hydraulic fluid 14, and thus, pressure, in the hydraulic cylinder 18. In addition, in this embodiment, two hydraulic cylinders 18 are provided, namely a left hydraulic cylinder 34 and a right hydraulic cylinder 36. The left hydraulic cylinder 34 is attached to one side of the platform P in order to facilitate coordinated movement with the right hydraulic cylinder 36, which is attached to the right side of the platform P.

As further illustrated in FIG. 3, a hand pump 38 is positioned in the hydraulic circuit 16 and between two check valves 40 and 42. These check valves 40, 42 are used to ensure that hydraulic fluid 14 can only be moved through the hand pump 38 in a single direction, and allow hydraulic pressure to be raised in the hydraulic cylinders 34, 36. In particular, and in such an emergency or "manual" situation, the operator can actuate the hand pump 38 and force hydraulic fluid 14 into both the left hydraulic cylinder 34 and the right hydraulic cylinder 36 (at the same rate), and thereby move the platform P from the ground position GP to the deployed position DP and/or the deployed position DP to the stowed position SP.

As further illustrated in FIG. 3, a system relief valve 44 ensures that the pressure of hydraulic fluid 14 in the hydraulic circuit 16 is relieved when it reaches a specific threshold. For example, in one preferred and non-limiting embodiment, the system relief valve 44 is set to 103 bar or 1500 psi. If pressure is building in the hydraulic circuit 16 through operation of the pump 22, and this pressure reaches these thresholds, the system relief valve 44 opens and allows the hydraulic fluid 14 to dump to the fluid storage unit 26 and/or the fluid reservoir 32. Check valves 46 and 48 are also positioned in a path in the hydraulic circuit 16 between the pump 22 and the hydraulic cylinders 34, 36. Check valve 46 is used to prevent back flow of hydraulic fluid 14 to the system relief valve 44, while check valve 48 is utilized to ensure that no backflow occurs to the pump 22.

In normal operation, the platform P is unfolded from the stowed position SP to the deployed position DP by gravity by opening a down valve 50 and allowing hydraulic fluid 14 to move to the fluid reservoir 32. Further, and in order to regulate the flow of hydraulic fluid 14 to the down valve 50, a deploy orifice 52 and associated check valve 54 are used. This deploy orifice 52 provides restrictive (and, thus controlled) flow of hydraulic fluid 14 to the down valve 50, while the check valve 54 prevents flow to the hydraulic cylinders 34, 36 through the deploy orifice 52. This check valve 54 is primarily used to ensure that a full flow of hydraulic fluid 14 is permitted when moving the platform P from the ground position GP to the deployed position DP.

In order to increase the speed for the travel of the platform P from the deployed position DP to the ground position GP, a solenoid-operated spool valve 56 is also positioned in the hydraulic circuit 16. When actuated, the spool valve 56 provides a bypass to the deploy orifice 52, thereby allowing a much greater flow of hydraulic fluid 14 to be removed from the hydraulic cylinders 34, 36 and, thereby, faster operation, such as when the operator is deploying and lowering the platform P without a person positioned thereon.

In normal operation, and in order to urge the platform P from the ground position GP to the deployed position DP, the pump 22 is activated with the spool valve 56 open. This ensures full, pressurized flow of hydraulic fluid 14 to the hydraulic cylinders 34, 36. In this mode of operation, the down valve 50 is closed. Further regulation of the flow of hydraulic fluid 14 to and from the hydraulic cylinders 34, 36 occurs through the use of a left flow control valve 58 and a right flow control valve 60. Each of the left flow control valve 58 and right flow control valve 60 uses an orifice 62 and a check valve 64. In particular, the orifice 62 is used to regulate the flow of hydraulic fluid 14 from the hydraulic cylinder 34, 36 during the movement from the stowed position SP to the deployed position DP, and further from the deployed position DP to the ground position GP. Further, based upon the orientation of check valve 64, the flow of hydraulic fluid 14 is prevented through the check valve 64 during these movements, while allowing full flow of hydraulic fluid 14 to the hydraulic cylinders 34, 36 during the movement from the ground position GP to the deployed position DP, and from the deployed position DP to the stowed position SP.

As further illustrated in the preferred and non-limiting embodiment of FIG. 3, the pressure regulating valve 20 is positioned in the path between the pump 22 and the hydraulic cylinders 34, 36. As discussed, this pressure regulating valve 20 is configured to allow flow therethrough only until the valve 20 reaches a specific pressure setting. Therefore, the pressure regulating valve 20 ensures continual and reduced pressure of hydraulic fluid 14, which thereby ensures that the platform P cannot move from the deployed position DP to the stowed position SP if a specified load is wholly or partially positioned thereon.

In operation, the pressure regulating valve 20 may also be used in connection with a stow orifice 66 and a check valve 68. The stow orifice assists in regulating flow to the hydraulic cylinders 34, 36, while the check valve 68 prevents backflow of hydraulic fluid 14 to the pressure regulating valve 20. For example, if a heavy load was placed on the platform P, and the operator attempted to actuate the platform P from the deployed position DP to the stowed position SP, the hydraulic fluid 14 would build in pressure and attempt to move in the opposite direction. This backflow is prevented through the use of the check valve 68.

Still further, in effecting the movement of the platform P from the deployed position DP to the stowed position SP, both the down valve 50 and the spool valve 56 are closed, such that the entire supply of hydraulic fluid 14 to the hydraulic cylinders 34, 36 is accomplished through the pressure regulating valve 20. Since the pressure regulating valve 20 is operable to only provide hydraulic fluid 14 at a specific rate and/or pressure, in the absence of a load (e.g., a wheelchair, a passenger, or any other weight exceeding the specified threshold), enough pressure can be built in the hydraulic cylinders 34, 36 in order to stow the platform P. However, if the load on the platform is too great, (i.e., over the threshold), the pressure of hydraulic fluid 14 delivered by the pressure regulating valve 20 to the hydraulic cylinders 34, 36 would be ineffective in stowing the platform P.

As discussed in detail above, the pressure regulating valve 20 is always present in the hydraulic circuit 16. During normal operation of moving the platform P from the ground position GP to the deployed position DP, while still present in the hydraulic circuit 16, the pressure regulating valve 20 cannot deliver the same amount of hydraulic fluid 14 that moves through the open spool valve 56. However, when spool valve 56 is closed, thus preventing flow therethrough, the only passage of hydraulic fluid 14 must be through the pressure regulating valve 20.

It should also be noted that the spool valve 56 is a fail-shut valve, such that if any mechanical or electrical problems occur, it remains impossible for hydraulic fluid 14 to be supplied to the hydraulic cylinders 34, 36 to stow the platform P. Therefore, if the pressure of the hydraulic cylinders 34, 36 is higher than the setting of the pressure regulating valve 20, the check valve 68 isolates the pressure regulating valve 20 from the pressure at the hydraulic cylinders 34, 36. As discussed above, this prevents the pressure regulating valve 20 from reducing the pressure at the hydraulic cylinders 34, 36 and lowering the platform P.

In general, the pressure regulating valve 20 is operable to regulate the flow of hydraulic fluid 14 through the pressure regulating valve 20, and further operable to maintain a specified pressure of the hydraulic fluid 14 delivered therefrom. In one preferred and non-limiting embodiment, the load on the platform P that would prevent the platform P from stowing is in the range of about 20 pounds to about 100 pounds, and preferably in the range of about 40 pounds and about 60 pounds. However, this innovative use of a pressure regulating valve 20 allows the manufacturer to set and the operator to set and/or adjust this specified threshold based upon the configuration of the access arrangement A or its operation in specific uses and environments.

Figure 4:
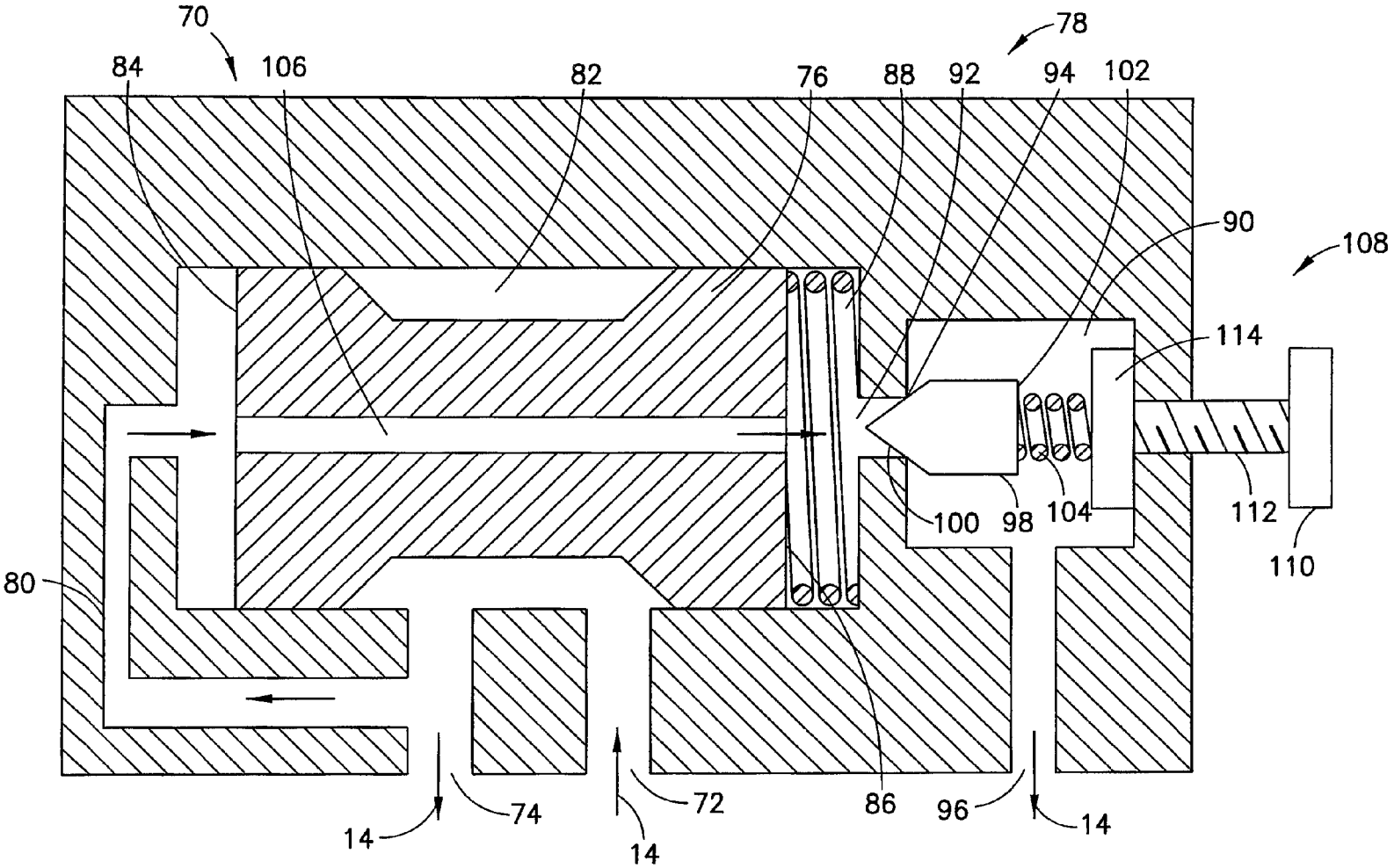
FIG. 4 is a schematic view of one embodiment of a pressure regulating valve for use in a hydraulic system and arrangement for an access arrangement according to the principles of the present invention.

As illustrated in FIG. 4, and in one preferred and non-limiting embodiment, the pressure regulating valve 20 is a pilot-operated pressure regulating valve 70. As seen in this figure, the valve 70 includes an upstream port 72 through which hydraulic fluid 14 flows from the hydraulic power unit 12, and a downstream port 74 through which the hydraulic fluid 14 is delivered to the hydraulic cylinder 18. In addition, a main valve spool 76 is used to throttle the flow of hydraulic fluid 14 through the downstream port 74 and to the hydraulic cylinder 18. In addition, a pilot arrangement 78 is provided and configured to cause the main valve spool 76 to throttle the flow of hydraulic fluid 14 by throttling the flow of the hydraulic fluid 14 through the pilot arrangement 78 based upon the pressure differential across the valve 70.

As further illustrated in FIG. 4, a hydraulic fluid passageway 80 provides fluid communication between the downstream port 74 and a main valve spool chamber 82. The main valve spool 76 is positioned within the main valve spool chamber 82, and in this embodiment, the main valve spool 76 includes a first end 84 and a second end 86. In particular, the main valve spool 76 is slidingly positioned within the chamber 82, and a main spring 88 contacts the second end 86 of the spool 76. This main spring 88 urges the main valve spool 76 in a first direction away from the pilot arrangement 78.

In this preferred and non-limiting embodiment, the pilot arrangement 78 includes a pilot chamber 90 including an inlet 92 defining a seat 94 and an outlet 96 that permits release of hydraulic fluid 14, such as to fluid reservoir 28 or fluid storage unit 26. A movable pilot plug 98 includes a first end 100 and a second end 102, and is urged towards the seat 94 by a pilot spring 104. If the pressure exerted by the hydraulic fluid 14 on the pilot plug 98 reaches a specified threshold, the pilot plug 98 overcomes the urging force of the pilot spring 104 and unseats, thereby permitting hydraulic fluid 14 to flow to the outlet 96. Therefore, the pilot spring 104 is used to set the pressure at which the pilot-operated pressure regulating valve 70 operates.

Further, when the pilot plug 98 unseats, the main valve spool 76 overcomes the urging of the main spring 88 by the pressure exerted by the hydraulic fluid 14 on the first end 84 of the spool 76. In this manner, the spool 76 moves in a second direction towards the pilot arrangement 78, and throttles the passage of hydraulic fluid 14 through the downstream port 74 based upon the upstream hydraulic fluid pressure and/or the downstream hydraulic fluid pressure. In this manner, regulated flow of hydraulic fluid 14 through the valve 70 is continually provided to the hydraulic cylinder 18. In addition, and in order to allow the pilot arrangement 78 to operate, fluid communication is provided to the pilot plug 98, such as through a main valve spool passageway 106. Of course, any suitable arrangement that allows the appropriate pressure to be sensed by the pilot arrangement 78 is envisioned, such that the pilot plug 98 can unseat and allow for the passage of hydraulic fluid 14 to the outlet 96. Under normal operating conditions, and when the load on the platform P is below the specified threshold when the operator attempts to stow the platform P, the main valve spool 76 is urged by the main spring 88 in the first direction, thereby permitting full passage of hydraulic fluid 14 through the downstream port 74. It is to be understood that any pressure regulating valve or device that is capable of effectively regulating pressure and/or flow therethrough to a specified level could be used in the context and system of the present invention.

In a further preferred and non-limiting embodiment, the pilot arrangement 78 includes an adjustment mechanism 108 that allows for the adjustment of the urging force of the pilot spring 104. In one embodiment, this adjustment mechanism 108 includes a knob 110 connected to a shaft 112 that includes a spring stop 114 at one end thereof. The pilot spring 104 is compressed between the spring stop 114 and the second end 102 of the pilot plug 98. In operation, the knob 110 is configured to move the spring stop 114 towards and away from the second end 102 of the pilot plug 98, thereby compressing and decompressing the pilot spring 104 and adjusting the urging force of the pilot spring 104. This allows the specified threshold, i.e., the load at which the platform P should not be stowed, to be adjustable through correlation with the urging force on the pilot spring 104 on the pilot plug 98. In addition, the first end 100 of the pilot plug 98 can be specifically sized and shaped to appropriately and sealingly engage the seat 94 and prevent the flow of hydraulic fluid 14 into pilot chamber 90.

Figure 5:
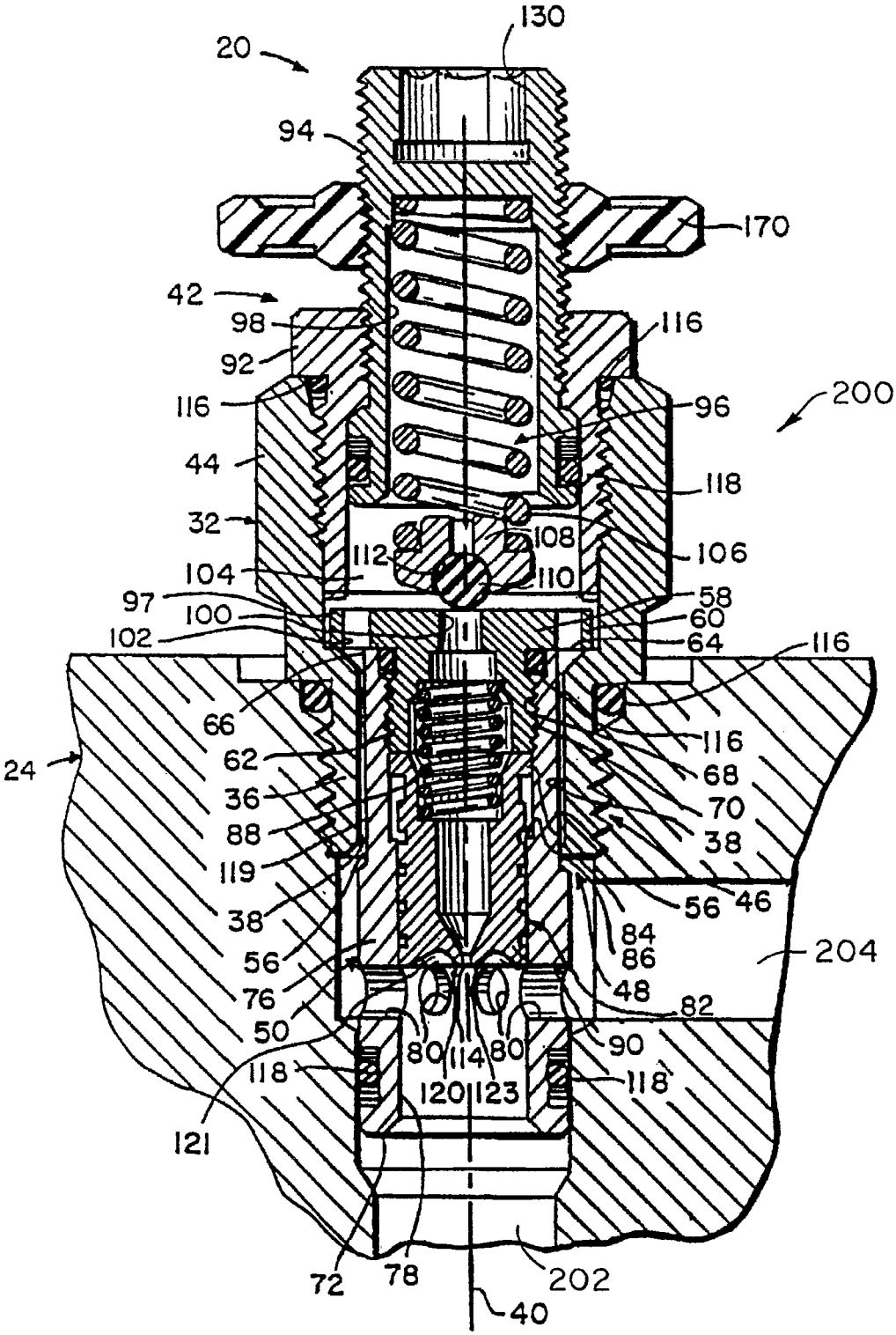
FIG. 5 is a side sectional view of another embodiment of a pressure regulating valve in one state of operation and for use in a hydraulic system and arrangement for an access arrangement according to the principles of the present invention.
Figure 6:
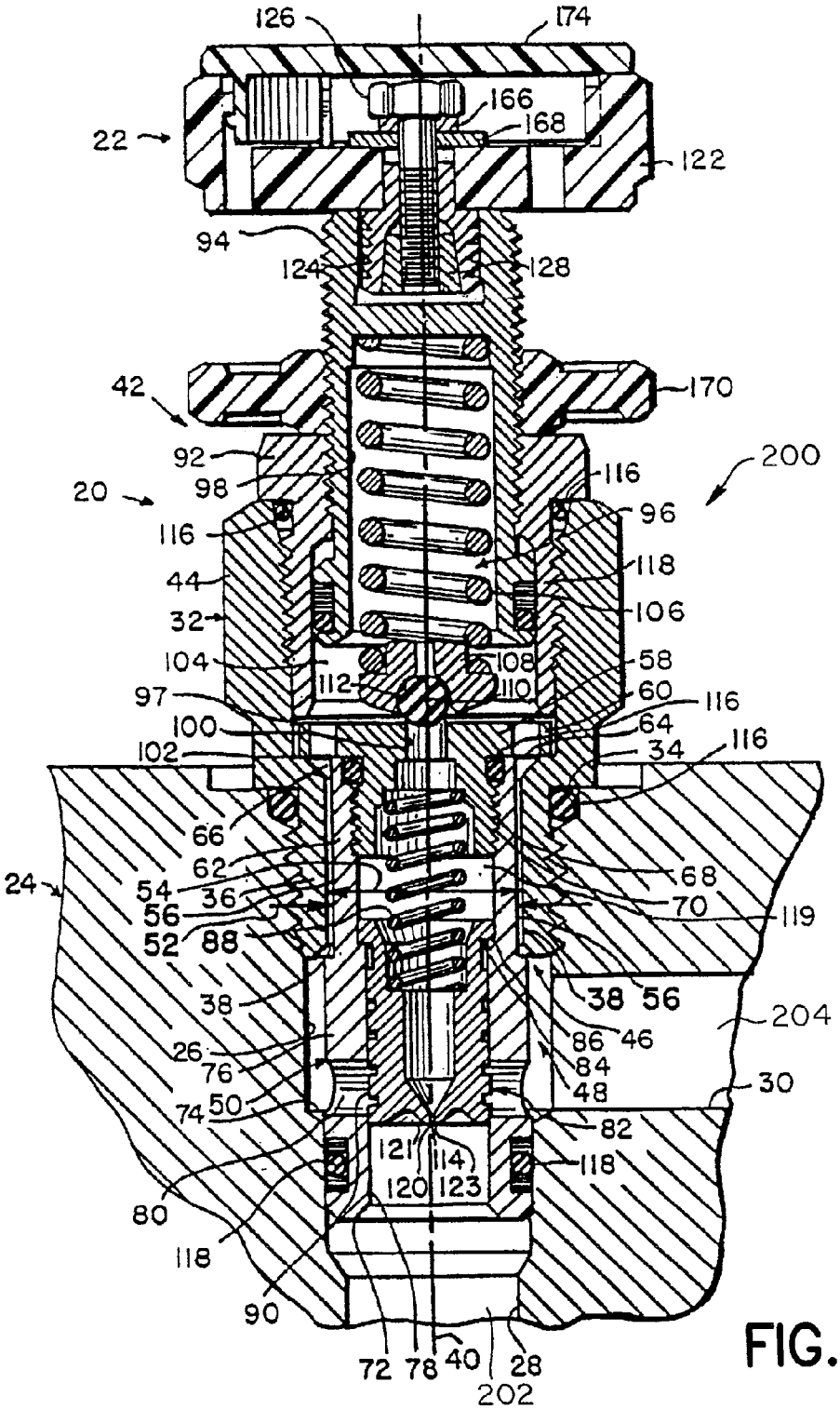
FIG. 6 is a side sectional view of the pressure regulating valve of FIG. 5 in another state of operation.

In another preferred and non-limiting embodiment, the pilot-operated pressure regulating valve 200 (illustrated in two different states of operation in FIGS. 5 and 6) may also be utilized. This valve 200 is fully described in U.S. Pat. No. 5,546,980, which is incorporated by reference herein in its entirety. The '980 patent describes a floating cage cartridge valve and knob, and corresponds to Valve Model No. PRPS-8 and/or PRPS-10 of Command Controls Corporation. The pilot-operated pressure regulating valve 200 disclosed in the '980 patent, and as used herein, operates to regulate flow between an upstream port 202 and downstream port 204. The specific mechanical operation of this particular valve 200 is fully described in the '980 patent with continued reference to FIGS. 5 and 6 of the present application.

While two different variants of an appropriate pressure regulating valve have been discussed above, any appropriate valve can be utilized in the context and environment of the present invention. One of the primary purposes of using a pressure regulating valve as opposed to a full relief valve is the functional ability to maintain, but limit, the pressure of the hydraulic fluid 14 provided to the hydraulic cylinder 18 when the operator attempts to stow the platform P, i.e., move the platform P from the deployed position DP to the stowed position SP.

As discussed above, through this innovative use of a pressure regulating valve 20, the presently-invented hydraulic system and arrangement ensures that the platform P cannot be stowed when a person (or other object) is positioned thereon. Again, the specified threshold or load is adjustable by adjusting the pressure regulating valve 20. Accordingly, this threshold can be set to ensure that the platform P does not stow when a person, such as a person in a wheelchair, is sitting on the platform P or still in the process of moving from the platform P to the vehicle V.

However, if the specified threshold is set to a lower load, this may also be useful to ensure that an object of a certain weight is also not present thereon. Accordingly, the present invention may be used outside of the described environment, and used in connection with any similar lifting or actuating platforms that include a stowing position. For example, when used in the context of warehouse management, such an arrangement can be used to ensure that a platform is not holding or supporting loaded objects if an operator attempts to stow it without first removing these objects.

While, as discussed above, the presently-invented hydraulic system and arrangement can be used in a variety of environments and applications, it is particularly useful when used in connection with an access arrangement, which requires safe operation for the protection of the operator and users.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A hydraulic system for an access arrangement having a platform configured for movement between a deployed position and a stowed position, the hydraulic system comprising:

at least one hydraulic power unit configured to urge hydraulic fluid through a hydraulic circuit;

at least one hydraulic cylinder directly or indirectly connected to a portion of the platform and configured to urge the platform towards at least one of the stowed position and the deployed position;

a hydraulic circuit for delivering the hydraulic fluid through the hydraulic system, the hydraulic circuit defining at least one fluid path for delivering the hydraulic fluid from the at least one hydraulic power unit to the at least one hydraulic cylinder; and a pressure regulating valve positioned between the at least one hydraulic power unit and the at least one hydraulic cylinder in the at least one fluid path of the hydraulic circuit for delivering the hydraulic fluid from the at least one hydraulic power unit to the at least one hydraulic cylinder, wherein the pressure regulating valve is operable to prevent the at least one hydraulic cylinder from urging the platform to the stowed position if a load on the platform exceeds a specified threshold, wherein the hydraulic circuit defines at least one additional fluid path for delivering the hydraulic fluid from the at least one hydraulic power unit to the at least one hydraulic cylinder, wherein the hydraulic system further comprises at least one selectively controlled valve positioned between the at least one hydraulic power unit and the at least one hydraulic cylinder in the at least one additional fluid path of the hydraulic circuit for delivering hydraulic fluid from the at least one hydraulic power unit to the at least one hydraulic cylinder, and wherein the at least one selectively controlled valve is configured to close the at least one additional fluid path of the hydraulic circuit when the platform is urged to the stowed position.

2. The hydraulic system of claim 1, wherein the pressure regulating valve is operable to regulate the flow of hydraulic fluid through the pressure regulating valve.

3. The hydraulic system of claim 1, wherein the pressure regulating valve is operable to maintain a specified pressure of the hydraulic fluid delivered from the pressure regulating valve.

4. The hydraulic system of claim 1, wherein the specified threshold of the load is in the range of 20 pounds to 100 pounds.

5. The hydraulic system of claim 1, wherein the pressure regulating valve is a pilot-operated pressure regulating valve.

6. The hydraulic system of claim 1, wherein the pressure regulating valve comprises:

an upstream port through which hydraulic fluid flows from the at least one hydraulic power unit;

a downstream port through which hydraulic fluid is delivered to the at least one hydraulic cylinder;

a main valve spool configured to throttle the flow of hydraulic fluid through the downstream port and to the at least one hydraulic cylinder; and a pilot arrangement configured to cause the main valve spool to throttle the flow of fluid by throttling the flow of hydraulic fluid through the pilot arrangement based upon the pressure differential across the pressure regulating valve.

7. The hydraulic system of claim 6, further comprising a hydraulic fluid passageway between the downstream port and a main valve spool chamber, wherein the main valve spool, including a first end and a second end, is slidingly positioned within the main valve spool chamber and a main spring contacts the second end of the spool and urges the main valve spool in a first direction away from the pilot arrangement.

8. The hydraulic system of claim 7, wherein the pilot arrangement comprises:

a pilot chamber having an inlet defining a seat and an outlet configured to permit release of hydraulic fluid; and a moveable pilot plug having a first end and a second end and urged towards the seat by a pilot spring;

wherein, if the pressure exerted on the pilot plug reaches a specified threshold, the pilot plug overcomes the urging of the pilot spring and unseats, thereby permitting hydraulic fluid to flow to the outlet.

9. The hydraulic system of claim 8, wherein, when the pilot plug unseats, the main valve spool overcomes the urging of the main spring by exerting pressure on the first end of the main valve spool, such that the main valve spool moves in a second direction towards the pilot arrangement, and throttles the passage of hydraulic fluid through the downstream port based upon at least one of the upstream hydraulic fluid pressure and the downstream hydraulic fluid pressure.

10. The hydraulic system of claim 8, wherein, when the pilot plug is seated, the main valve spool is urged by the main spring in the first direction, and permits full passage of hydraulic fluid through the downstream port.

11. The hydraulic system of claim 8, wherein the pilot arrangement further comprises an adjustment mechanism configured to adjust the urging force of the pilot spring.

12. The hydraulic system of claim 11, wherein the adjustment mechanism comprises a knob with a shaft having a spring stop positioned at one end thereof, the pilot spring compressed between the spring stop and the second end of the pilot plug.

13. The hydraulic system of claim 12, wherein the knob is configured to move the spring stop towards and away from the second end of the pilot plug, thereby compressing and decompressing the pilot spring and adjusting the urging force of the pilot spring.

14. The hydraulic system of claim 8, wherein the first end of the pilot plug is shaped to sealingly engage the seat and prevent the flow of hydraulic fluid into the pilot chamber.

15. The hydraulic system of claim 6, wherein the pilot arrangement further comprises an adjustment mechanism.

16. The hydraulic system of claim 1, further comprising a left hydraulic cylinder and a right hydraulic cylinder connected to opposite sides of the platform and in fluid communication with the hydraulic power unit, wherein the left hydraulic cylinder and the right hydraulic cylinder operate in unison to move the platform between at least one of the stowed position, the deployed position, and the ground position.

17. In a hydraulic system for an access arrangement having a platform connected to at least one hydraulic cylinder configured to urge the platform between a deployed position and a stowed position, a hydraulic circuit for delivering hydraulic fluid through the hydraulic system, the hydraulic circuit defining at least one fluid path for delivering hydraulic fluid from at least one hydraulic power unit to the at least one hydraulic cylinder, and a pressure regulating valve positioned between the at least one hydraulic power unit and the at least one hydraulic cylinder in the at least one fluid path of the hydraulic circuit for delivering the hydraulic fluid from the at least one hydraulic power unit to the at least one hydraulic cylinder and configured to urge the hydraulic fluid through the at least one fluid path of the hydraulic circuit and to the at least one hydraulic cylinder, wherein the pressure regulating valve is operable to prevent the at least one hydraulic cylinder from urging the platform to the stowed position if a load on the platform exceeds a specified threshold, wherein the hydraulic circuit defines at least one additional fluid path for delivering the hydraulic fluid from the at least one hydraulic power unit to the at least one hydraulic cylinder, wherein the hydraulic system further comprises at least one selectively controlled valve positioned between the at least one hydraulic power unit and the at least one hydraulic cylinder in the at least one additional fluid path of the hydraulic circuit for delivering hydraulic fluid from the at least one hydraulic power unit to the at least one hydraulic cylinder, and wherein the at least one selectively controlled valve is configured to close the at least one additional fluid path of the hydraulic circuit when the platform is urged to the stowed position.

18. The hydraulic system of claim 17, wherein pressure regulating valve is a pilot-operated pressure regulating valve.

19. The hydraulic system of claim 17, wherein the specified threshold of the load is in the range of 20 pounds to 100 pounds.

20. A hydraulic arrangement for an access arrangement having a platform configured for movement between a deployed position and a stowed position, the hydraulic arrangement comprising:

fluid urging means for urging hydraulic fluid through a hydraulic circuit;

platform urging means for urging a platform towards at least one of the stowed position and the deployed position;

a hydraulic circuit for delivering the hydraulic fluid through the hydraulic arrangement, the hydraulic circuit defining at least one fluid path for delivering the hydraulic fluid from the fluid urging means to the platform urging means; and pressure regulating means positioned between the fluid urging means and the platform urging means in the at least one fluid path of the hydraulic circuit for delivering the hydraulic fluid from the fluid urging means to the platform urging means, wherein the pressure regulating means prevents the platform urging means from urging the platform to the stowed position if a load on the platform exceeds a specified threshold by limiting the pressure of the hydraulic fluid conveyed through the pressure regulating means, wherein the hydraulic circuit defines at least one additional fluid path for delivering the hydraulic fluid from the fluid urging means to the platform urging means, wherein the hydraulic arrangement further comprises at least one selectively controlled valve positioned between the fluid urging means and the platform urging means in the at least one additional fluid path of the hydraulic circuit for delivering hydraulic fluid from the fluid urging means to the platform urging means and wherein the at least one selectively controlled valve is configured to close the at least one additional fluid path of the hydraulic circuit when the platform is urged to the stowed position.

* * * * *